US012599240B2

(12) United States Patent
Sin et al.

(10) Patent No.: US 12,599,240 B2
(45) Date of Patent: Apr. 14, 2026

(54) LUMBAR SUPPORT ASSEMBLY AND RELATED METHOD, AND A BACKREST ASSEMBLY

(71) Applicant: SECRETLAB SG PTE. LTD., Singapore (SG)

(72) Inventors: Vincent Sin, Singapore (SG); Cheng Feng Elroy Lee, Singapore (SG)

(73) Assignee: Secretlab SG Pte. Ltd., Singapore (SG)

( * ) Notice: Subject to any disclaimer, the term of this patent is extended or adjusted under 35 U.S.C. 154(b) by 185 days.

(21) Appl. No.: 18/576,599

(22) PCT Filed: Sep. 29, 2021

(86) PCT No.: PCT/SG2021/050585
§ 371 (c)(1),
(2) Date: Jan. 4, 2024

(87) PCT Pub. No.: WO2023/282845
PCT Pub. Date: Jan. 12, 2023

(65) Prior Publication Data

US 2024/0306821 A1 Sep. 19, 2024

(30) Foreign Application Priority Data

Jul. 5, 2021 (SG) ..... 1020210738T

(51) Int. Cl.
*A47C 7/46* (2006.01)

(52) U.S. Cl.
CPC ..... *A47C 7/465* (2013.01)

(58) Field of Classification Search
CPC ..... A47C 7/465; A47C 7/462; A47C 7/46; B60N 2/66; B60N 2/6671; B60N 2/667; B60N 2/6673
(Continued)

(56) References Cited

U.S. PATENT DOCUMENTS 6,588,842 B2 * 7/2003 Stumpf ..... A47C 1/03 297/452.64
6,644,740 B2 * 11/2003 Holst ..... B60N 2/6671 297/284.4
(Continued)

FOREIGN PATENT DOCUMENTS

CN 202800809 U * 3/2013
EP 1 656 052 B1 5/2006
(Continued)

OTHER PUBLICATIONS

International Search Report and Written Opinion for PCT Appl. No. PCT/SG2021/050585, mailed on Jan. 4, 2022.

*Primary Examiner* — Jose V Chen
(74) *Attorney, Agent, or Firm* — VIERING, JENTSCHURA & PARTNER mbB

(57) ABSTRACT

A lumbar support assembly, a backrest assembly, and a method for manufacturing a lumbar support assembly are provided. The lumbar support assembly includes a plate member configured to flex and conform to a lumbar region of a user, the plate member includes a mesh structure including a plurality of interconnected elements. The interconnected elements define a plurality of Y-shaped voids therebetween, and each interconnected element includes an edge portion thinner than a center portion. The lumbar support assembly also includes a frame member supporting the plate member.

14 Claims, 8 Drawing Sheets

(58) Field of Classification Search
USPC ..... 297/284.4
See application file for complete search history.

(56) References Cited

U.S. PATENT DOCUMENTS

| | | | | | |
|---|---|---|---|---|---|
| 6,692,074 | B1 * | 2/2004 | Kopetzky | B60N 2/666 | 297/284.4 |
| 6,969,115 | B2 * | 11/2005 | Bourdkane | A47C 7/465 | 297/284.4 |
| 7,097,247 | B2 * | 8/2006 | Battey | A47C 1/03255 | 297/284.7 |
| 7,120,984 | B2 * | 10/2006 | Rutsch | B60N 2/6671 | 264/261 |
| 7,425,036 | B2 * | 9/2008 | McMillen | A47C 7/465 | 297/284.4 |
| 7,585,027 | B2 * | 9/2009 | Blendea | A47C 7/465 | 297/284.4 |
| 7,770,972 | B2 * | 8/2010 | Popa | B60N 2/0296 | 297/284.7 |
| 7,874,616 | B2 * | 1/2011 | D'Agostini | B60N 2/66 | 297/216.12 |
| 8,651,575 | B2 * | 2/2014 | Okamoto | B60N 2/66 | 297/284.4 |
| 2002/0036420 | A1 * | 3/2002 | Footitt | A47C 1/03205 | 297/284.4 |
| 2005/0062323 | A1 * | 3/2005 | Dicks | A47C 7/402 | 297/284.4 |
| 2005/0104428 | A1 * | 5/2005 | Walker | A47C 7/402 | 297/284.4 |
| 2005/0280299 | A1 * | 12/2005 | Vogt | B60N 2/6671 | 297/284.4 |
| 2007/0236063 | A1 * | 10/2007 | Blendea | B60N 2/6671 | 297/284.4 |
| 2009/0127895 | A1 * | 5/2009 | Gentry | A47C 7/744 | 297/180.11 |

FOREIGN PATENT DOCUMENTS

| | | | | |
|---|---|---|---|---|
| JP | 4242348 | B2 * | 3/2009 | B60N 2/6673 |
| KR | 1020200110966 | A | 9/2020 | |
| WO | WO-2007022629 | A1 * | 3/2007 | B60N 2/6671 |

* cited by examiner

LUMBAR SUPPORT ASSEMBLY AND RELATED METHOD, AND A BACKREST ASSEMBLY

CROSS-REFERENCE TO RELATED APPLICATIONS

The present application is a U.S. National Stage Application under 35 U.S.C. § 371 of International Patent Application No. PCT/SG2021/050585, filed on Sep. 29, 2021, which claims priority to Singapore patent application Ser. No. 10/202,107378T, filed on Jul. 5, 2021, the disclosure of both of which is hereby incorporated by reference in entirety for all purposes.

FIELD OF INVENTION

The present invention relates broadly, but not exclusively, to a lumbar support assembly, a backrest assembly and a method for manufacturing a lumbar support assembly.

BACKGROUND

Chairs commonly used in offices or homes typically comprise a backrest and a seat base. Increasingly, chairs may be designed with features to provide comfort to users. For example, the backrest may be designed with a curvature to support a lumbar region of the user when the user leans back on the chair.

The backrest of a typical chair has a fixed curvature when bent. However, chair users may have varying sizes, shapes and weights. As such, different users have different needs with regard to the curvature of the backrest. In other words, chairs with backrests of a fixed curvature when bent may not meet the needs of the users.

A need therefore exists to provide a lumbar support assembly that seeks to address at least some of the above problems.

SUMMARY

According to a first aspect, there is provided a lumbar support assembly, comprising: a plate member configured to flex and conform to a lumbar region of a user, the plate member comprising a mesh structure comprising a plurality of interconnected elements, the interconnected elements define a plurality of Y-shaped voids therebetween, and each interconnected element comprises an edge portion thinner than a center portion; and a frame member supporting the plate member.

The Y-shaped voids may be disposed in a two-dimensional array, and the Y-shaped voids may form an alternating pattern along one direction of the two-dimensional array.

The lumbar support assembly may further comprise a plurality of first spring members connecting the plate member and the frame member. The first spring members may be configured to bias the plate member between a lowered position and a raised position.

The first spring members may comprise coil springs.

The lumbar support assembly may further comprise a first actuator configured to move the plate member between the lowered and raised positions.

The lumbar support assembly may further comprise a plurality of second spring members attached to the plate member. The second spring members may be configured to bias the plate member between a flexed state and a released state.

The second spring members may comprise leaf springs.

The lumbar support assembly may further comprise a second actuator configured to drive the plate member between the flexed and released states.

The plate member may comprise a plurality of tabs extending laterally outwardly from opposing sides of the plate member.

According to a second aspect, there is provided a backrest assembly, comprising: the lumbar support assembly as described above; and a back support layer. The frame member of the lumbar support assembly is attached to the back support layer.

The back support layer may comprise a foam material.

The backrest assembly may further comprise one or more contact elements disposed at one or more contact areas between the plate member of the lumbar support assembly and the back support layer, and the contact elements may be made of polyoxymethylene (POM).

The backrest assembly may further comprise a non-woven material at least partially covering the back support layer.

According to a third aspect, there is provided a method for manufacturing a lumbar support assembly, comprising: forming a plate member; and mounting the plate member to a frame member. Forming the plate member comprises forming a mesh structure comprising a plurality of interconnected elements such that the interconnected elements define the plurality of Y-shaped voids therebetween, and each interconnected element comprises an edge portion thinner than a center portion.

BRIEF DESCRIPTION OF THE DRAWINGS

Embodiments and implementations are provided by way of example only, and will be better understood and readily apparent to one of ordinary skill in the art from the following written description, read in conjunction with the drawings, in which.

DETAILED DESCRIPTION

Figure 1A:
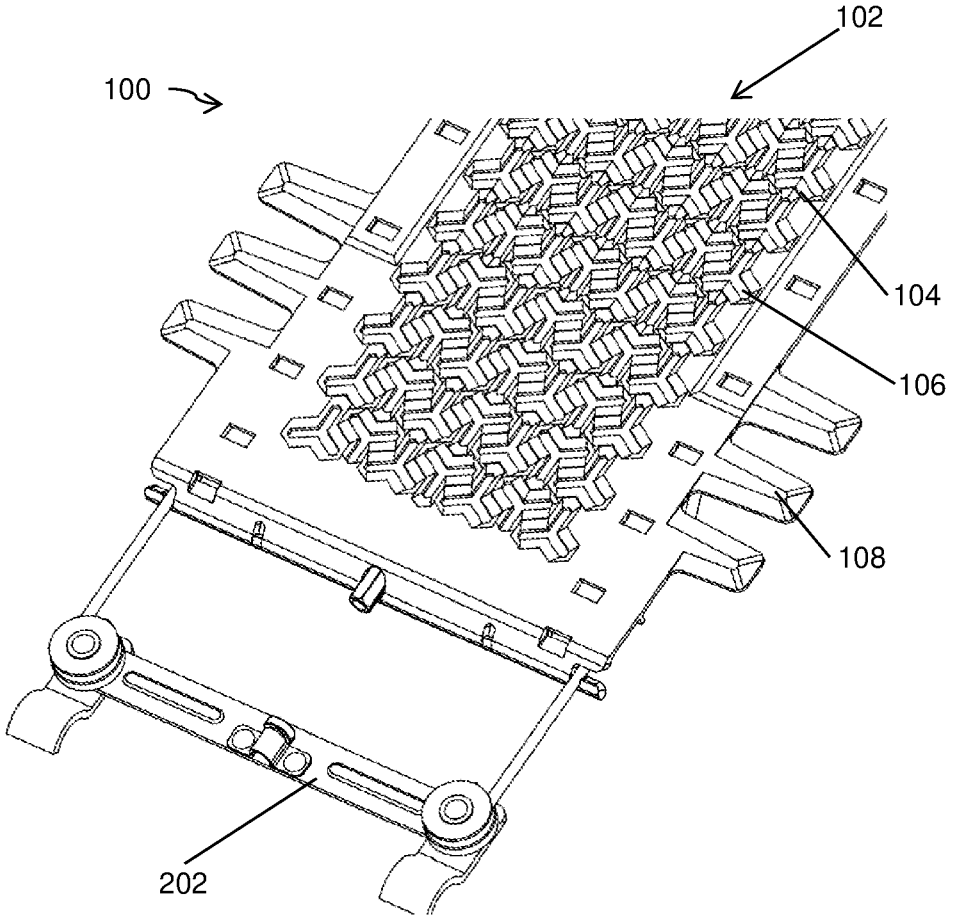
FIG. 1A is a partial perspective view of a lumbar support assembly, according to an example embodiment.

Embodiments will be described, by way of example only, with reference to the drawings. Like reference numerals and characters in the drawings refer to like elements or equivalents.

To provide comfort to users, a backrest of a chair may be designed with a curvature to support a lumbar region of the user when the user leans back on the chair. For example, a plate member may be included in the backrest to provide the curvature. Plate members currently in the market may have a consistent thickness across the entire plate member. This may result in the plate member having a fixed curvature when bent. Further, with consistent thickness across the entire plate member, the plate member may only bend along one axis, hence the plate member may only curve in a single direction.

Embodiments of the invention provide a lumbar support assembly comprising a plate member that can flex and conform to a lumbar region of each user. This may provide improved comfort to each user without a need to customize each backrest according to the size and curvature of the user's back.

Figure 1B:
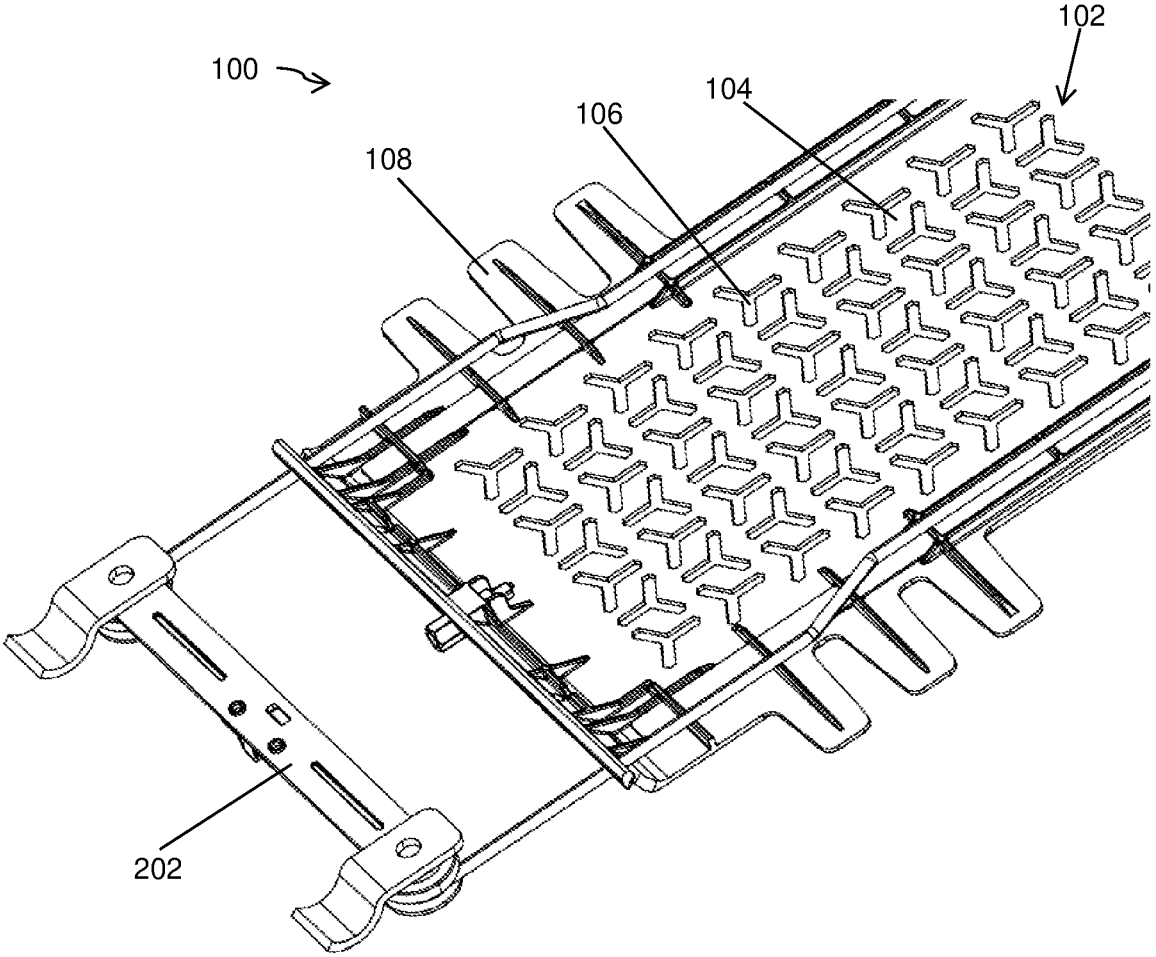
FIG. 1B is a perspective view of an opposing side of the assembly of FIG. 1A.
Figure 1C:
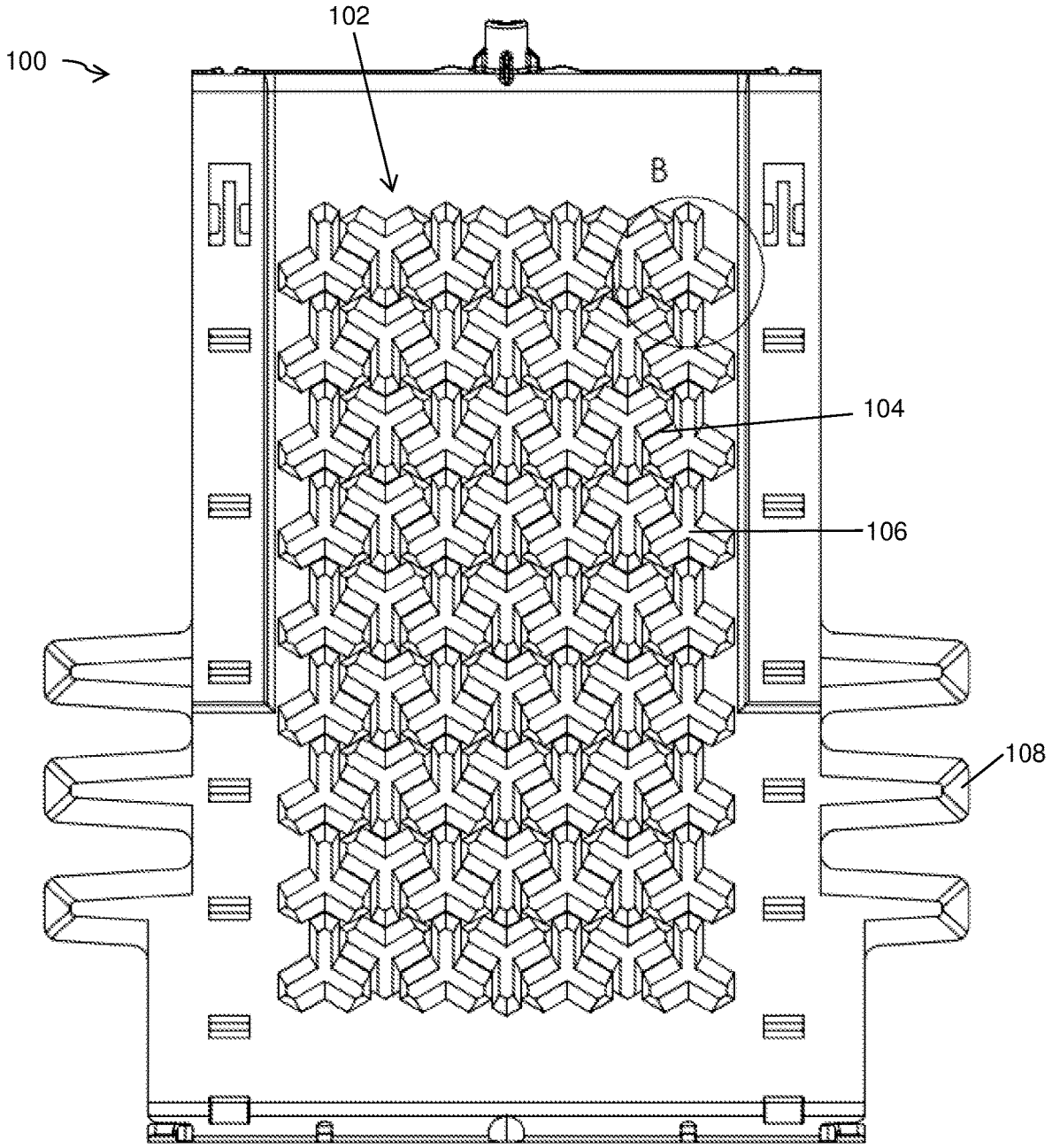
FIG. 1C is a front view of the plate member of FIG. 1A.
Figure 1D:
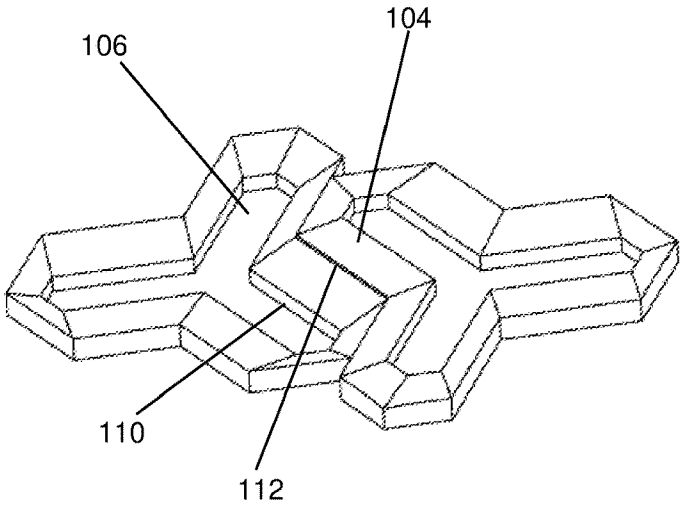
FIG. 1D shows Y-shaped voids formed by interconnected elements of a mesh structure of the plate member of FIG. 1A.
Figure 1D:
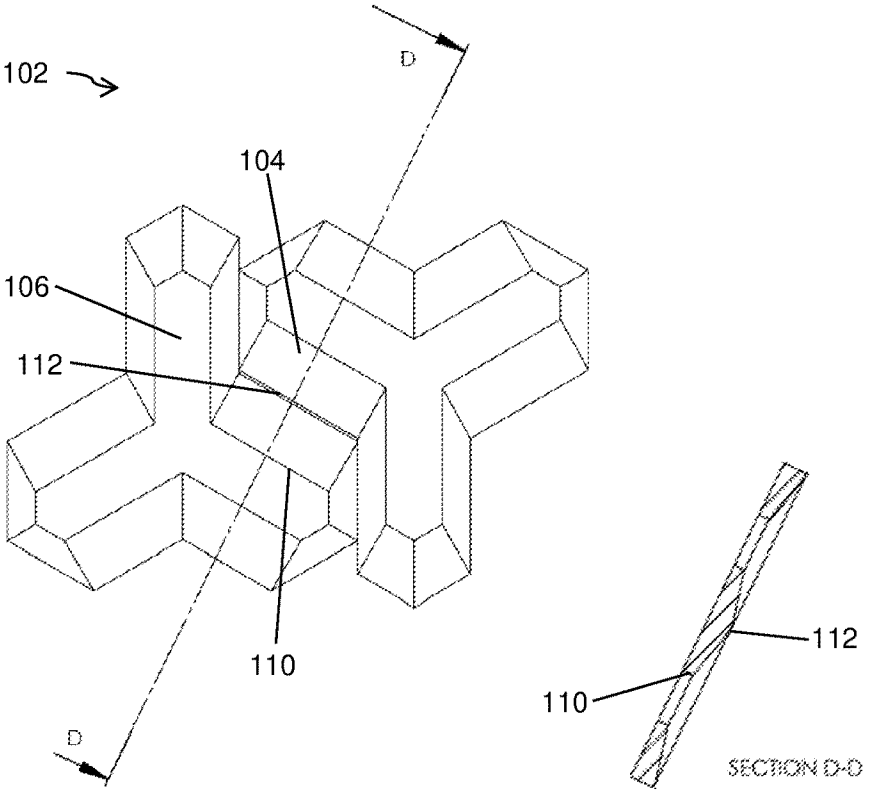

FIG. 1A is a partial perspective view of a lumbar support assembly 200 (FIG. 2), according to an example embodiment. FIG. 1B is a perspective view of an opposing side of the assembly 200 of FIG. 1A. FIG. 1C is a front view of the plate member 100 of FIG. 1A. FIG. 1D shows Y-shaped voids 106 formed by interconnected elements 104 of a mesh structure 102 of the plate member 100 of FIG. 1A. As described in further details below, the plate member 100 can flex and conform to a lumbar region of a user. The plate member 100 comprises a mesh structure 102. The mesh structure 102 comprises a plurality of interconnected elements 104. As shown in FIG. 1D, the interconnected elements 104 define a plurality of Y-shaped voids 106 therebetween. In other words, the interconnected elements 104 separate adjacent Y-shaped voids. Each interconnected element 104 comprises an edge portion 110 thinner than a center portion 112.

The plate member 100 may be made of a suitable material that provides flexibility allowing the plate member 100 to be flexed when a force is applied. For example, the plate member 100 may be made of plastic. Other materials may be used to provide different stiffness or flexibility of the plate member 100.

As mentioned, the interconnected elements 104 define a plurality of Y-shaped voids 106 therebetween. The plate member 100 may bend across the length of the Y-shaped voids 106. As such, the direction of the bending of the plate member 100 may be controlled by varying the arrangement of the Y-shaped voids 106 thereon. Further, the area of the interconnected elements 104 adjacent the upper halves of the Y-shaped voids 106 (the V shapes) may provide support across the V shapes such that the plate member 100 may retain at least part of its structural rigidity.

According to one embodiment, the Y-shaped voids 106 may be disposed in a two-dimensional array. Further, the Y-shaped voids 106 may form an alternating pattern along one direction of the two-dimensional array. As shown in FIG. 1C, the two-dimensional array may include horizontal rows and vertical columns. The Y-shaped voids 106 may form an alternating pattern along the horizontal rows of the two-dimensional array. For example, the Y-shaped voids 106 along the horizontal direction may be arranged such that the orientation of each adjacent horizontal Y-shaped void 106 is rotated at 180 degrees. Adjacent Y-shaped voids 106 along the vertical direction may be arranged with a same orientation. This may allow compact arrangement of the Y-shaped voids 106 so as to provide enhanced flexibility of the plate member 100. Stiffness or flexibility of the plate member 100 may be controlled, for example, by changing the arrangement of the Y-shaped voids 106 and/or varying the density or distribution of the Y-shaped voids 106 in the plate member 100.

Each interconnected element 104 comprises an edge portion 110 thinner than a center portion 112. As shown in FIG. 1D, each interconnected element 104 can have a varying thickness with the edge portion 110 that is adjacent the Y-shaped void 106 thinner than the center portion 112 that is farthest from the Y-shaped void 106. The thinner areas may allow the plate member 100 to be flexed with less force. Also, in this manner, the stiffness of the plate member 100 may be reduced and the plate member 100 may be bent along 2 axes. Therefore, the plate member 100 may flex in such a way that it conforms to the lumbar region of a user, and may provide enhanced support and better comfort. The variance in thickness of the interconnected elements 104 may differ according to the desired flexibility of the plate member 100. In other words, stiffness or flexibility of the plate member 100 may be controlled, for example, by varying the thickness of the edge portion 110 of the interconnected elements 104 relative to the center portion 112.

According to one embodiment, the plate member 100 may comprise a plurality of tabs 108 extending laterally outwardly from opposing sides of the plate member 100. In some implementations, the plate member may include six tabs 108, with three tabs 108 on each side of the plate member 100. The tabs 108 may be disposed at the lower portion of the plate member 100. The tabs 108 can provide additional structural support, hence may enhance support for the user when he/she shifts left or right while sitting on the chair. It will be appreciated that the number of tabs may vary in alternate implementations.

Figure 2A:
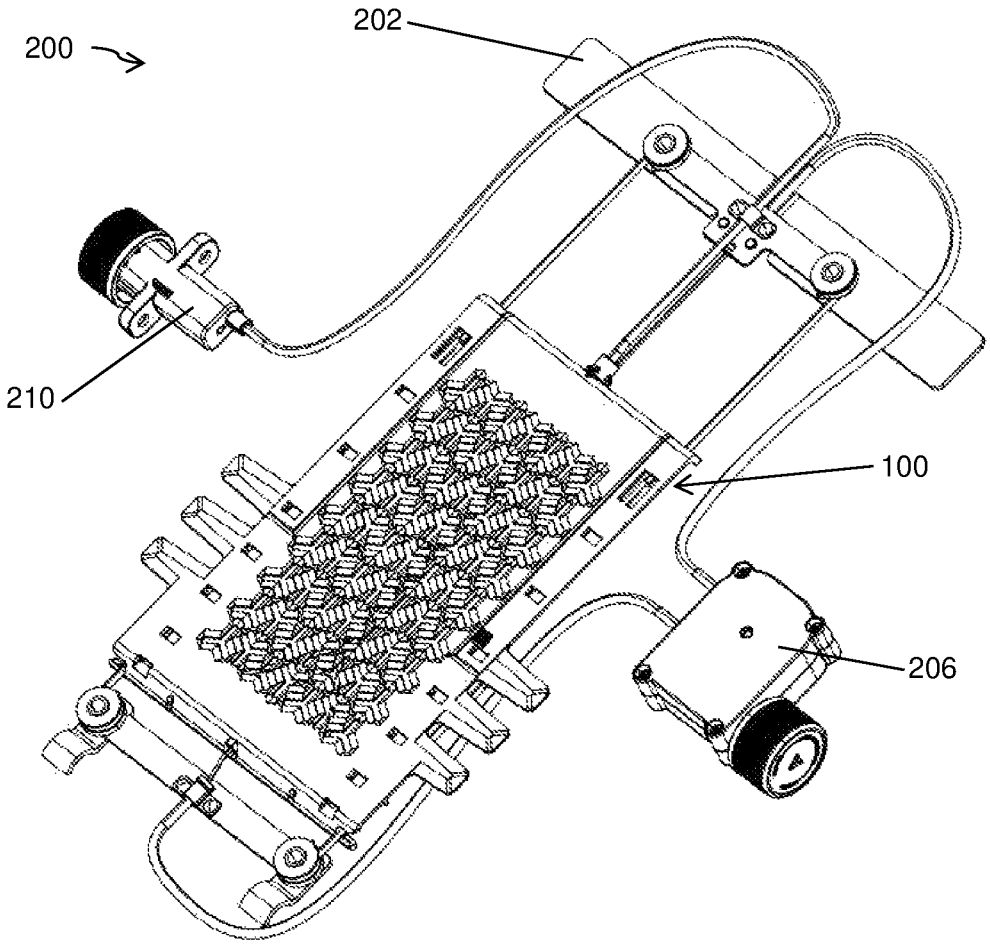
FIG. 2A is a schematic representation of the lumbar support assembly comprising the plate member of FIG. 1A mounted on a frame member.
Figure 2B:
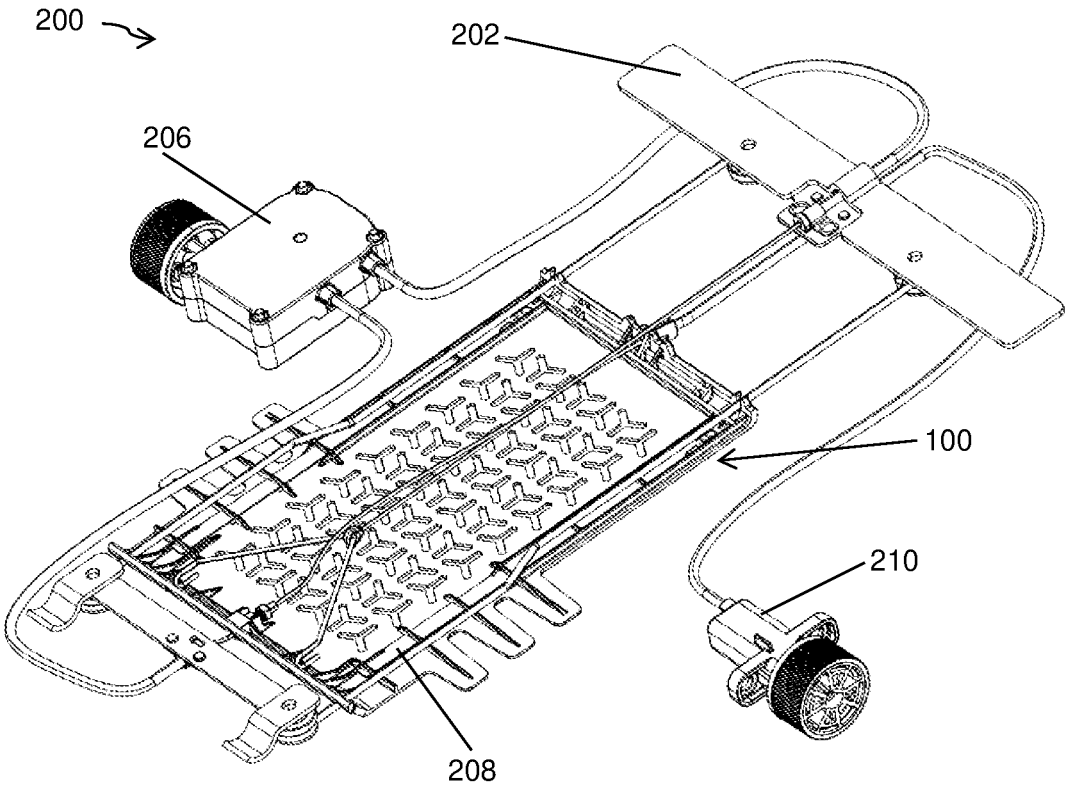
FIG. 2B is a schematic representation of an opposing side of the lumbar support assembly of FIG. 2A.

FIG. 2A is a schematic representation of the lumbar support assembly 200 comprising the plate member 100 of FIG. 1A mounted on a frame member 202 such that the frame member 202 supports the plate member 100. FIG. 2B is a schematic representation of an opposing side of the lumbar support assembly 200 of FIG. 2A. In some embodiments, the lumbar support assembly 200 may further comprise a plurality of first spring members connecting the plate member 100 and the frame member 202. The first spring members are configured to bias the plate member 100 between a lowered position and a raised position. For example, the first spring members may be disposed between the upper side of the plate member 100 and the frame member 202. In this manner, the first spring members may bias the plate member 100 towards the raised position when in use. Alternatively, the first spring members may be disposed between the lower side of the plate member 100 and the frame member 202. In use, the first spring members may then bias the plate member 100 towards the lowered position.

In some implementations, the lumbar support assembly 200 may include two such first spring members. According to one embodiment, the first spring members may comprise coil springs.

The lumbar support assembly 200 may further comprise a first actuator 206 configured to move the plate member 100 between the lowered and raised positions. The first actuator 206 may be connected to the plate member 100 with a cable such as a Bowden cable. The first actuator 206 may pull or release the cable to move the plate member 100 between the lowered and raised positions.

The first actuator 206 can be a worm gear actuator. The gear ratio of the worm gear actuator can be adjusted such that each turn of the knob of the worm gear actuator results in the cable connected to the plate member 100 being pulled or released by a longer length. This may reduce the number of turns a user needs to make on the worm gear actuator knob before the plate member 100 can be adjusted to the desired position, thereby increasing convenience for the user.

In some embodiments, the lumbar support assembly 200 may further comprise a plurality of second spring members 208 attached to the plate member 100. The second spring members 208 are configured to bias the plate member 100 between a flexed state and a released state. The second spring members 208 may be disposed at the sides and along the vertical length of the plate member 100. The second spring members 208 may improve rigidity of the plate member 100 at the sides such that the plate member 100 may only flex in the central area where the user's lumbar region rests on. This may allow the plate member 100 to better conform to the lumbar region of the user. Stiffness of the second spring members 208 can be selected based on the desired rigidity or flexibility of the plate member 100. For example, the second spring members 208 may comprise leaf springs.

The lumbar support assembly 200 may further comprise a second actuator 210 configured to drive the plate member 100 between the flexed and released states. The second actuator 210 may be connected to the plate member 100 with a cable. The cable can be a Bowden cable. The second actuator 210 may pull or release the cable to move the plate member 100 between the flexed and released states. For example, the second actuator 210 may pull the cable to cause the plate member 100 to bend to a predetermined extent, resulting in a desired curvature.

The second actuator 210 can be a lead screw actuator. The screw threading of the lead screw actuator can be designed such that each turn of the knob of the lead screw actuator results in the cable connected to the plate member 100 being pulled or released by a longer length. This may reduce the number of turns a user needs to make on the lead screw actuator knob before the plate member 100 can be adjusted to the desired curvature, thereby increasing convenience for the user.

As described above, stiffness or flexibility of the plate member 100 can be controlled by varying the arrangement of the Y-shaped voids 106, the density or distribution of the Y-shaped voids 106, the thickness of the edge portion 110 of the interconnected elements 104 relative to the center portions 112, material of the plate member 100, and/or stiffness of the second spring members 208, etc. For example, a lumbar support assembly 200 with greater stiffness may be suitable for larger chairs which may be used by heavier users.

Figure 3:
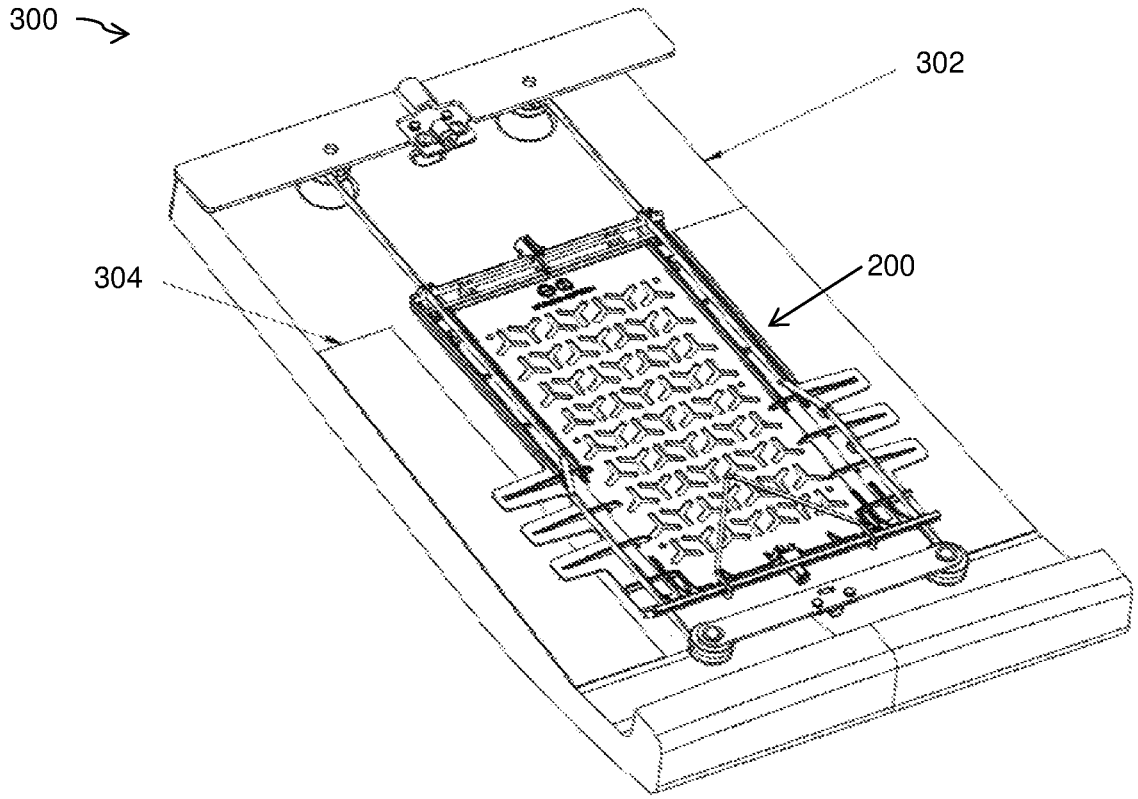
FIG. 3 is a schematic representation of a backrest assembly comprising the lumbar support assembly of FIG. 2A.

FIG. 3 is a schematic representation of a backrest assembly 300 comprising the lumbar support assembly 200 of FIG. 2A. The backrest assembly 300 comprises the lumbar support assembly 200 as described above and a back support layer 302. The frame member 202 of the lumbar support assembly 200 is attached to the back support layer 302. The back support layer 302 can be made of a suitable material that can support the weight of the back of users. For example, the back support layer 302 can comprise a foam material. In use, the backrest assembly 300 may be mounted to a frame (not shown) that can provide structural support to the backrest assembly 300.

The backrest assembly 300 may further comprise one or more contact elements 304 disposed at one or more contact areas between the plate member 100 of the lumbar support assembly 200 and the back support layer 302. The contact elements 304 can be made of a material with low coefficient of friction and good wear resistance. As a non-limiting example, the contact elements 304 are made of polyoxymethylene (POM).

As shown in FIG. 3, in some implementations, there may be two strips of contact elements 304 disposed between the plurality of tabs 108 extending laterally outwardly from opposing sides of the plate member 100, and the back support layer 302. In this manner, there can be a larger contact area between the strips of contact elements 304 and the back support layer 302 as compared to that between the tabs 108 and back support layer 302 without the strips of contact elements 304. Load of the plate member 100 exerted on the back support layer 302 through the tabs 108 can be distributed along the larger contact area. This may reduce wear and tear of the back support layer 302 and improve its durability.

In use, the plate member 100 may slide along the back support layer 302 as the user adjusts the plate member 100 to achieve desired position and curvature. The contact elements 304 can provide a low coefficient of friction surface which may improve smoothness of motion of the plate member 100 as it slides along the back support layer 302.

The backrest assembly 300 may further comprise a non-woven material at least partially covering the back support layer 302. As a non-limiting example, the non-woven material can be non-woven cloth overmoulded onto the back support layer 302 at areas where the plate member 100 contacts the back support layer 302. Friction between the plate member 100 and the back support layer 302 may be reduced and smoothness of motion of the plate member 100 as it slides along the back support layer 302 may be improved. Further, sound created due to friction between the plate member 100 and the back support layer 302 may be dampened or reduced. Wear and tear of the back support layer 302 may also be reduced, thus improving its durability.

Figure 4:
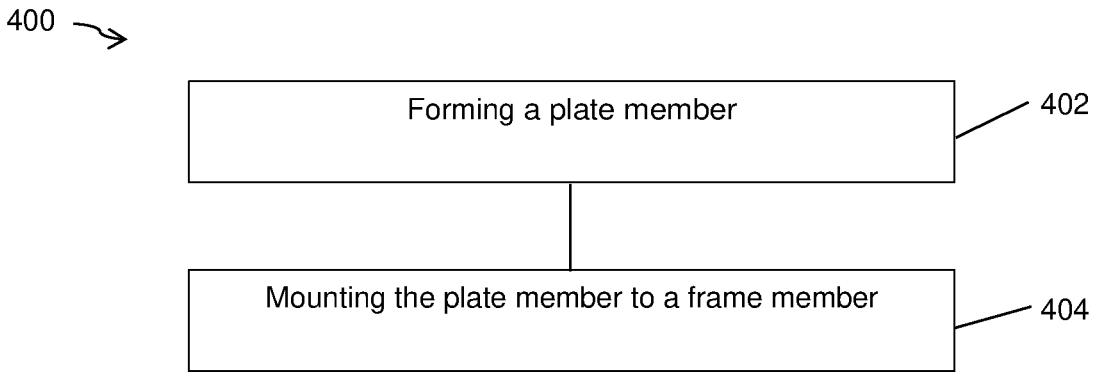
FIG. 4 is a flowchart illustrating a method for manufacturing a lumbar support assembly, according to an example embodiment.

FIG. 4 is a flowchart 400 illustrating a method for manufacturing a lumbar support assembly, according to an example embodiment. At step 402, a plate member is formed. At step 404, the plate member is mounted to a frame member. Forming the plate member comprises forming a mesh structure comprising a plurality of interconnected elements such that the interconnected elements define the plurality of Y-shaped voids therebetween. Each interconnected element comprises an edge portion thinner than a center portion. The plurality of Y-shaped voids in the plate member may be formed by stamping for example.

It will be appreciated by a person skilled in the art that numerous variations and/or modifications may be made to the present invention as shown in the specific embodiments without departing from the spirit or scope of the invention as broadly described. For example, the exact dimensions of the plate member may vary depending on the dimensions of the backrest assembly. Also, other manufacturing processes, such as casting, can be used to fabricate the plate member. The present embodiments are, therefore, to be considered in all respects to be illustrative and not restrictive.

The invention claimed is:

1. A lumbar support assembly, comprising:

a plate member configured to flex and conform to a lumbar region of a user, the plate member comprising a mesh structure comprising a plurality of interconnected elements, wherein the interconnected elements are arranged and spaced to define a plurality of Y-shaped voids therebetween, and wherein each interconnected element comprises an edge portion positioned adjacent a corresponding Y-shaped void and a center portion positioned farthest from the corresponding Y-shaped void, the edge portion being thinner than the center portion; and a frame member supporting the plate member.

2. The lumbar support assembly of claim 1, wherein the Y-shaped voids are disposed in a two-dimensional array, and wherein the Y-shaped voids form an alternating pattern along one direction of the two-dimensional array.

3. The lumbar support assembly of claim 1, further comprising a plurality of first spring members connecting the plate member and the frame member, wherein the first spring members are configured to bias the plate member between a lowered position and a raised position.

4. The lumbar support assembly of claim 3, wherein the first spring members comprise coil springs.

5. The lumbar support assembly of claim 3, further comprising a first actuator configured to move the plate member between the lowered and raised positions.

6. The lumbar support assembly of claim 1, further comprising a plurality of second spring members attached to the plate member, wherein the second spring members are configured to bias the plate member between a flexed state and a released state.

7. The lumbar support assembly of claim 6, wherein the second spring members comprise leaf springs.

8. The lumbar support assembly of claim 6, further comprising a second actuator configured to drive the plate member between the flexed and released states.

9. The lumbar support assembly of claim 1, wherein the plate member comprises a plurality of tabs extending laterally outwardly from opposing sides of the plate member.

10. A backrest assembly, comprising:

the lumbar support assembly of claim 1; and a back support layer, wherein the frame member of the lumbar support assembly is attached to the back support layer.

11. The backrest assembly of claim 10, wherein the back support layer comprises a foam material.

12. The backrest assembly of claim 10, further comprising one or more contact elements disposed at one or more contact areas between the plate member of the lumbar support assembly and the back support layer, wherein the contact elements are made of polyoxymethylene (POM).

13. The backrest assembly of claim 12, further comprising a non-woven material at least partially covering the back support layer.

14. A method for manufacturing a lumbar support assembly, comprising:

forming a plate member; and mounting the plate member to a frame member, wherein forming the plate member comprises forming a mesh structure comprising a plurality of interconnected elements such that the interconnected elements are arranged and spaced to define a plurality of Y-shaped voids therebetween, and wherein each interconnected element comprises an edge portion positioned adjacent a corresponding Y-shaped void and a center portion positioned farthest from the corresponding Y-shaped void, the edge portion being thinner than the center portion.

* * * * *